US007423663B2

(12) United States Patent
Nishitani

(10) Patent No.: US 7,423,663 B2
(45) Date of Patent: Sep. 9, 2008

(54) PRINTER APPARATUS

(75) Inventor: Hitoshi Nishitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 11/080,413

(22) Filed: Mar. 16, 2005

(65) Prior Publication Data

US 2005/0212895 A1 Sep. 29, 2005

(30) Foreign Application Priority Data

Mar. 23, 2004 (JP) ..... 2004-085010

(51) Int. Cl.
*B41J 2/325* (2006.01)

(52) U.S. Cl. ..... 347/217

(58) Field of Classification Search ..... 347/217, 347/219, 213, 101, 221; 400/641, 619
See application file for complete search history.

(56) References Cited

U.S. PATENT DOCUMENTS 4,480,933 A * 11/1984 Shibayama et al. ..... 400/619
5,160,944 A * 11/1992 Fukumoto et al. ..... 347/219
5,172,989 A * 12/1992 Imaseki et al. ..... 400/641
5,708,467 A * 1/1998 Yoshikawa et al. ..... 347/213
6,568,776 B1 * 5/2003 Kato ..... 347/8
2002/0154205 A1 * 10/2002 Kaya ..... 347/177
2004/0095451 A1 * 5/2004 Tatsumi et al. ..... 347/101

FOREIGN PATENT DOCUMENTS

JP 2531358 6/1996
JP 2003-39760 2/2003

* cited by examiner

*Primary Examiner*—K. Feggins
(74) *Attorney, Agent, or Firm*—Fitzpatrick, Cella, Harper & Scinto

(57) ABSTRACT

An object of the invention is to provide a printer apparatus which can perform printing to the whole surface of a recording sheet with no margin while print quality is not lost. A configuration of the invention is a printer apparatus which has a printing unit comprising a pressing member which is provided in parallel with a heat generating unit of the thermal head while being opposite the heat generating unit of the thermal head; a first roller which is provided in parallel with the pressing member; and an endless belt which is extended with a tension so as to involve the pressing member and the first roller. In the printer apparatus, the thermal head is pressed against the pressing member through an ink sheet and the endless belt, the recording sheet is conveyed between the ink sheet and the endless belt, and the printing is performed by transferring ink in the ink sheet to the recording sheet with the thermal head.

28 Claims, 10 Drawing Sheets

PRINTER APPARATUS

BACKGROUND OF THE INVENTION

1. Field of the Invention

The present invention relates to a printer apparatus which prints an image in a recording material such as a recording sheet based on image information.

2. Related Background Art

Conventionally, printer apparatuses which are used for an output device of a computer or the output device for digital images can be divided into a thermal transfer type printer apparatus, an ink jet printer apparatus, a laser printer apparatus, a dot-wire printer apparatus and the like according to the recording methods. In the conventional printer apparatuses, line thermal transfer type printer apparatus is one in which an ink sheet and the recording sheet are used, plural heat generating elements arrayed in a main scanning direction are selectively driven while the ink sheet and the recording sheet are conveyed in a sub-scanning direction, and thereby the dot line-shaped image printing can be performed onto the recording sheet. Recently, a thermal transfer type printer apparatus comes to widespread attention with progress of input devices such as a digital camera, a digital camcorder, and a scanner which deal with the image. The thermal transfer type printer apparatus is suitable for the printer apparatus for performing print output of electronic image information taken by a still camera or a camcorder, which records a still picture, through a computer or a storage medium.

In the printer apparatuses adopting other printing methods such as the ink jet printer apparatus, because only binary selection whether a dot is formed or not exists, apparent resolution and gradation are obtained by techniques such as an error diffusion method while the small dots are formed on the recording sheet. On the other hand, in the thermal transfer type printer apparatus, because a controllable heat level can easily be changed in one pixel, a number of gray scale levels can be secured for one pixel. Therefore, the thermal transfer type printer apparatus has an advantage that smooth image can be obtained with high quality when compared with other printer apparatuses such as the ink jet printer apparatus. Further, in the thermal transfer type printer apparatus, performance of a thermal head which is of recording means and performance of a recording sheet material are also improved, so that an image print which is not pale against a silver-salt print in finished quality. Therefore, in particular the thermal transfer type printer apparatus receives attention for the printer which outputs a natural image as it keeps pace with the recent progress of the digital camera.

A system, in which a print of the image information is directly output without directly connecting the thermal transfer type printer apparatus and the image pickup devices such as the digital camera and the digital camcorder or without processing the image information by the devices such as the computer, already comes on the market. According to such systems, a photographic print of the image information from the digital camera and the digital camcorder can easily be output, so that the thermal transfer type printer apparatus further comes to attention. However, in the thermal transfer type printer apparatus, it is necessary that the transfer is performed by repeatedly superposing plural color kinds of ink in order to perform full color printing. A general configuration for realizing the full color printing will be described below.

FIGS. 9A and 9B schematically show a first example of a configuration of the conventional thermal transfer type printer. As shown in FIG. 9A, for the printing, a recording sheet P is wound around a platen roller 300 whose outer periphery is slightly longer than a total length of the recording sheet P, an ink sheet 302 and the recording sheet P are pressed by a thermal head 301 and the platen roller 300, ink on the ink sheet 302 is thermally transferred to the recording sheet P by heat generation of the thermal head 301 while the platen roller 300 is rotated. As shown in FIG. 9B, in order to perform the next color printing after the first color printing is completed, the press of the thermal head 301 is released, and the platen roller 300 is rotated to feed the recording sheet P to a printing start position. Then, the second color and subsequent other colors are printed by the same action as for the first color.

FIGS. 10A and 10B are schematic views showing a second example of the general configuration of the conventional thermal transfer type printer. As shown in FIG. 10A, for the printing, the ink sheet 302 and the recording sheet P are pressed by the thermal head 301 and a platen roller 303, and the recording sheet P is conveyed by a pair of a capstan roller 304 and a pinch roller 305, which is provided on the downstream side in a printing direction, while the ink on the ink sheet 302 is thermally transferred to the recording sheet P by the heat generation of the thermal head 301. As shown in FIG. 10B, in order to perform the next color printing after the first color printing is completed, the press of the thermal head 301 is released, and the recording sheet P is returned to the printing start position by rotating the pair of the capstan roller 304 and the pinch roller 305 and a pair of a return roller 306 and a pinch roller 307 in an opposite direction to the printing direction. Then, the second color and subsequent other colors are printed by the same action as for the first color.

The above two conventional methods are in common use. In the first example, since it is necessary to use the platen roller whose outer periphery is slightly longer than the total length of the recording sheet, the apparatus is enlarged. Further, a mechanism (not shown) which holds the recording sheet while the recording sheet is wound around the platen roller is also required, so that the first example has a demerit that the apparatus becomes complicated. However, when the first color printing is ended, since the printing start position of the second color exists immediately after the first color, a time for returning the recording sheet is not required unlike the second example. Therefore, the first example has a merit that high-speed printing is achieved.

On the other hand, the second example has the merit that both miniaturization and simplification are easy to realize in the apparatus while having the demerit that a printing time becomes longer.

While it is desirable that the photographic print of the image information from the digital camera and the digital camcorder is easily output, like a frameless photograph, a need to perform the printing to the whole surface of the recording sheet is increasing.

In the conventional first example, Japanese Patent Application Laid-Open No. 2003-39760 discloses the configuration in which the printing is performed to the whole surface of the recording sheet with no margin. However, in the configuration disclosed in Japanese Patent Application Laid-Open No. 2003-39760, the mechanism which winds the recording sheet around the platen roller is further complicated. Accordingly, the problems of the upsizing and the complication, which the conventional first example potentially owns, become further pronounced.

In the conventional second example, since the platen roller has no rotating mechanism, a leading end of the recording sheet can be conveyed only from a state in which the leading end is sandwiched between the capstan roller and the pinch roller, which generates a range where the printing cannot be performed to an upper end portion of the recording sheet. The range corresponds to a distance from the thermal head to the roller (shown by X in FIG. 10B).

In the configuration of the second example, the platen roller can be rotated. However, because hardness and a nip width of the platen roller are set so as to satisfy printing conditions caused by pressures and contact statuses between the thermal head and the ink sheet and between the ink sheet and the recording sheet, it is difficult to set the hardness and the nip width of the platen roller to the same level as for the capstan roller which has recording-sheet conveying accuracy necessary for the full color printing. On the contrary, when the hardness and the nip width of the platen roller are set to the same level as for the capstan roller which has the recording-sheet conveying accuracy necessary for the full color printing, there is a considerably high possibility that the printing conditions are not satisfied.

In the configuration close to the second example, Japanese Patent No. 2531358 discloses the configuration in which the printing is performed to the whole surface of the recording sheet with no margin. The configuration has the feature in that the belt is extended with a tension with a tension so as to involve the platen roller to convey the recording sheet. However, when the platen roller is driven while the belt is extended with a tension with a tension so as to involve the platen roller with a small winding angle like Japanese Patent No. 2531358, a slip is easy to occur between the platen roller and the inside surface of the belt, which directly worsens the recording-sheet conveying accuracy to impair the print quality. Further, as described above, since the settings of the hardness and the nip width of the platen roller are determined from the printing conditions, the settings cannot be performed while the higher priority is given to the conveying accuracy of the belt. Accordingly, the configuration disclosed in Japanese Patent No. 2531358, in which the belt and the recording sheet are conveyed using the printing platen roller as a main drive source, becomes a potential factor which impairs the print quality. Therefore, although the print quality can be permitted in the monochrome direct thermal printer in which ribbon is not used, the high-quality image similar to the photographic level cannot substantially be achieved when the configuration disclosed in Japanese Patent No. 2531358 is adopted to the full color printer.

SUMMARY OF THE INVENTION

In view of the fore going, an object of the invention is to realize the printing in which the endless belt is conveyed with high accuracy to perform the printing to the whole surface of the recording sheet with no margin without impairing the print quality, in the thermal transfer type printer apparatus of the second example described above as the conventional configuration in which the printing is performed with the small-diameter platen roller having the advantages for the miniaturization and a reduction in thickness of the apparatus.

In order to solve the above problems, a thermal transfer printer apparatus of the invention includes a pressing member which is provided in parallel with a heat generating unit of a thermal head while being opposite the heat generating unit of the thermal head, a roller which is provided in parallel with the pressing member, an endless belt which is extended with a tension with a tension so as to involve the pressing member and the roller, and drive means for rotating the roller.

Thus, the endless belt is conveyed by driving not the platen roller but another roller, so that the printing conditions in the platen roller portion are compatible with the conditions that the endless belt is conveyed with high accuracy. In the thermal recording printer apparatus having the configuration in which the printing is performed with the small-diameter platen roller having the advantages for the miniaturization and the reduction in thickness of the apparatus, the endless belt can be conveyed with high accuracy to perform the printing to the whole surface of the recording sheet with no margin without impairing the print quality.

According to the invention, in the thermal recording printer apparatus having the configuration in which the printing is performed with the small-diameter platen roller having the advantages for the miniaturization and the reduction in thickness of the apparatus, the endless belt can be conveyed with high accuracy to perform the printing to the whole surface of the recording sheet with no margin without impairing the print quality.

DETAILED DESCRIPTION OF THE PREFERRED EMBODIMENTS

First Embodiment

Figure 1A:
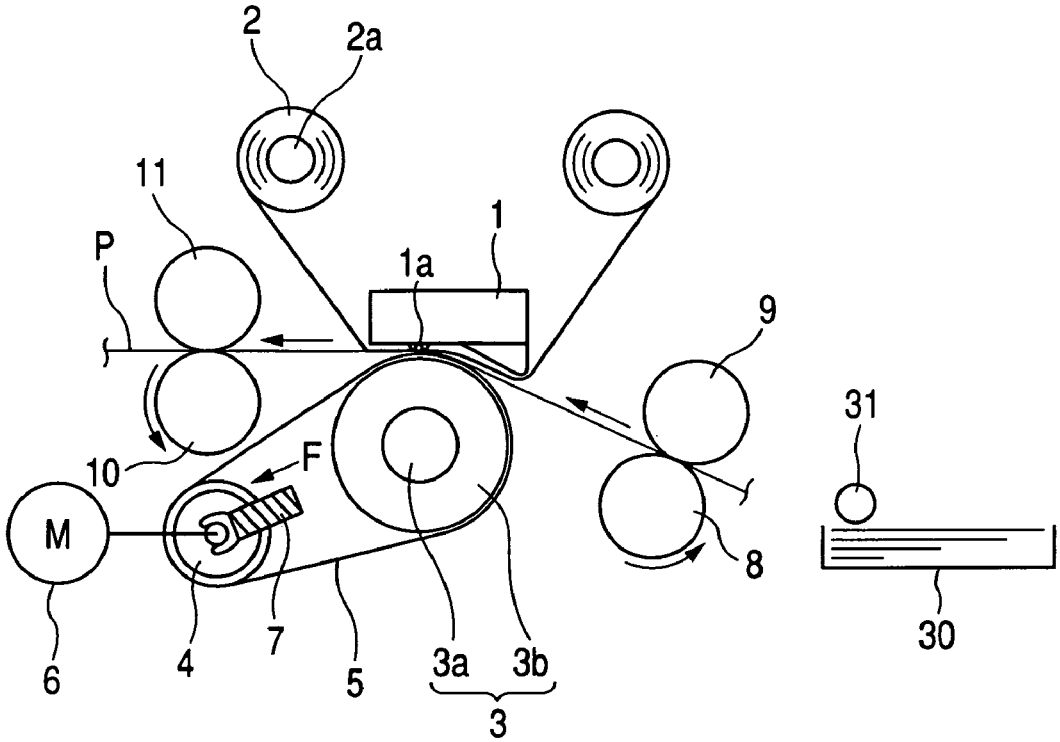
FIGS. 1A and 1B are explanatory views of a first embodiment of the invention.
Figure 1B:
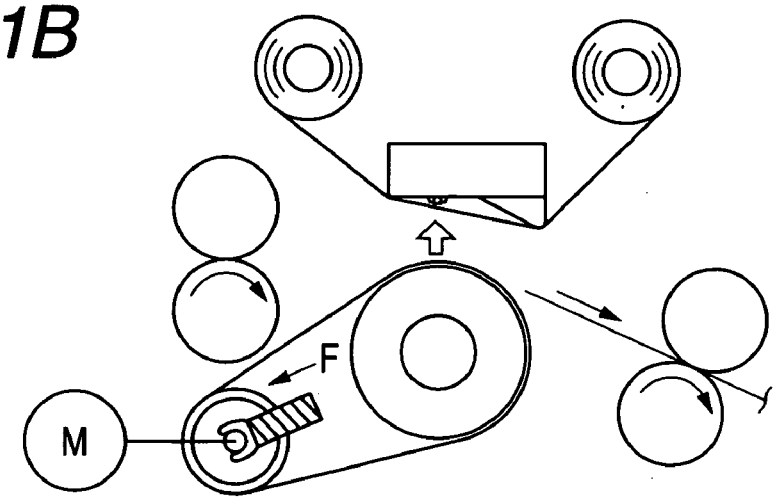

FIGS. 1A and 1B show a thermal recording printer apparatus or an image forming apparatus according to a first embodiment of the invention.

In FIG. 1A, the reference numeral 1 denotes a thermal head in which a heat generating unit 1*a* is formed. In the heat generating unit 1*a*, plural heating elements or plural heating resistors are linearly arranged. The reference numeral 2 denotes an ink sheet to which ink is applied. The reference numeral 3 denotes a platen roller which is of a pressing member or a guide member. The platen roller 3 is provided opposite to the heat generating unit of the thermal head 1 while being parallel to the heat generating unit. The platen roller 3 includes a central axis 3*a* and an elastic rubber roller 3*b*. The reference numeral 4 denotes a drive roller which is of a first roller provided in parallel with the platen roller 3. The reference numeral 5 denotes an endless belt which is extended or extended with a tension so as to involve the platen roller 3 and the drive roller 4. The reference numeral 6 denotes drive means for rotating the drive roller 4. The drive means 6 includes a motor which is of a drive source.

Examples of the endless belt 5 include the belt having a single-layer structure in which an organic high-molecular compound (resin) having high rigidity and high heat-resisting properties such as polyimide, polycarbonate, and polyvinylidene fluoride are molded in the endless belt shape and the belt having a multi-layer structure in which an elastic layer or a ceramic particle coating layer is added onto a surface of the single-layer-structure endless belt by applying means, deposition means, and the like as necessary.

When the tension or the expansion and contraction by the heat exist, conveying accuracy of the recording sheet cannot be satisfied. Therefore, the sheet material having the high rigidity and high heat-resisting properties is required. When the elastic rubber layer such as silicone rubber or the ceramic particle coating layer is applied to the surface is required in order to adjust frictional force with the recording sheet, the sheet material having the multi-layer structure is required.

As described above, since the endless belt 5 hardly expands and contract, in at least one of the platen roller 3 and the drive roller 4, a position of a rotating axis is adapted to be adjusted in order to apply the tension to the endless belt 5. Alternatively, in order to apply the tension to the endless belt 5, it is desirable to provide a tension spring which biases at least one of the platen roller 3 and the drive roller 4 toward a direction in which the tension is applied to the endless belt 5. The reference numeral 7 denotes a tension spring which is of biasing means for biasing the drive roller 4 toward an arrow F direction.

Figure 2:
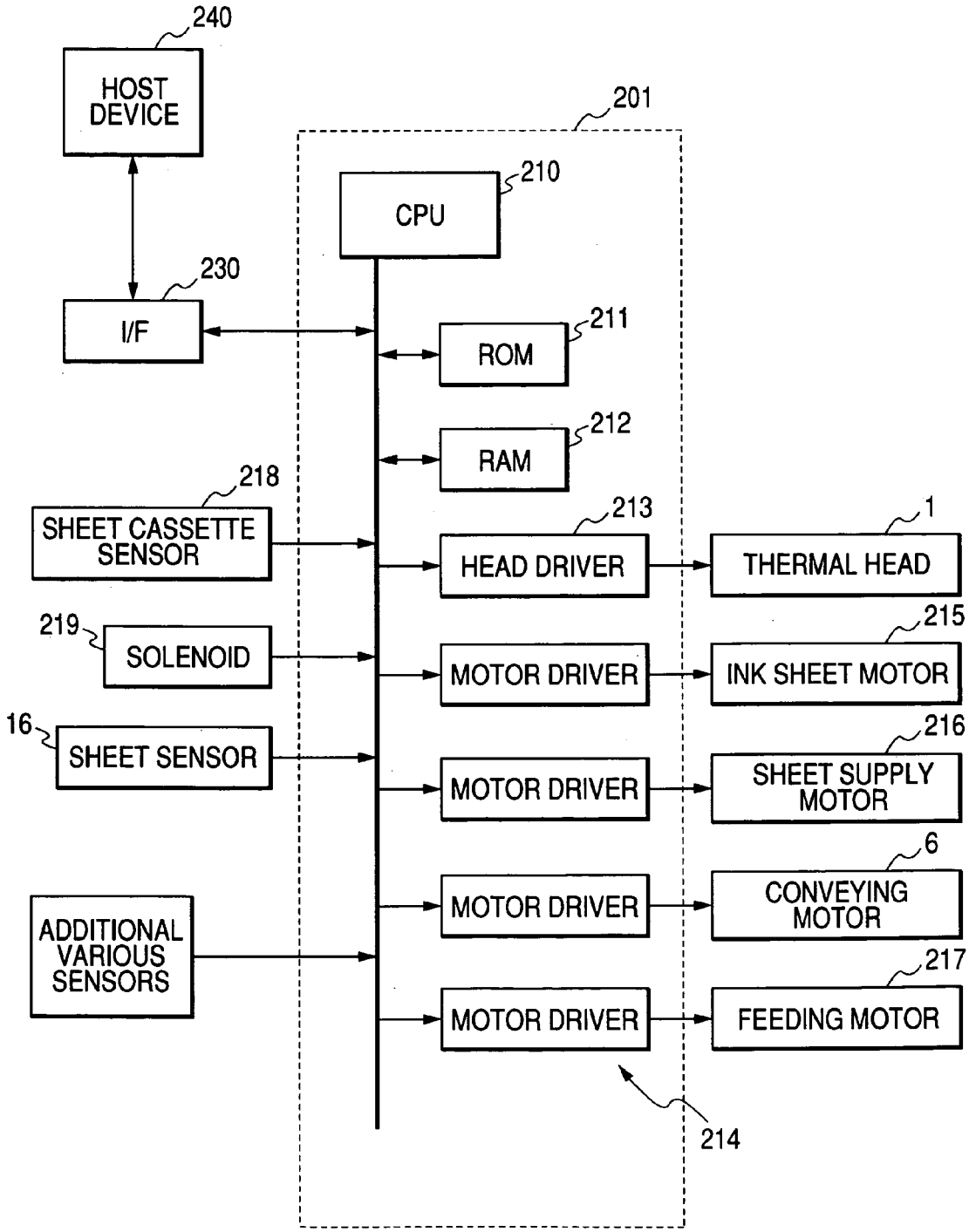
FIG. 2 is a control block diagram of the first embodiment.

FIG. 2 is a control block diagram of the whole of both-side recording apparatus.

A CPU 210 which controls the both-side recording apparatus and issues various control commands, a ROM 211 in which control data are written, a RAM 212 which becomes an area in which recording data and the like are expanded, and the like are provided on a control substrate 201.

The reference numeral 213 denotes a head driver which drives the recording head 1. The reference numeral 214 denotes plural motor drivers which drive an ink sheet motor 215, a sheet supply motor 216 and a conveying motor 6 respectively. The reference numeral 230 denotes an interface which transmits data to and receives data from a host device 240 such as the computer and the digital camera.

Figure 3:
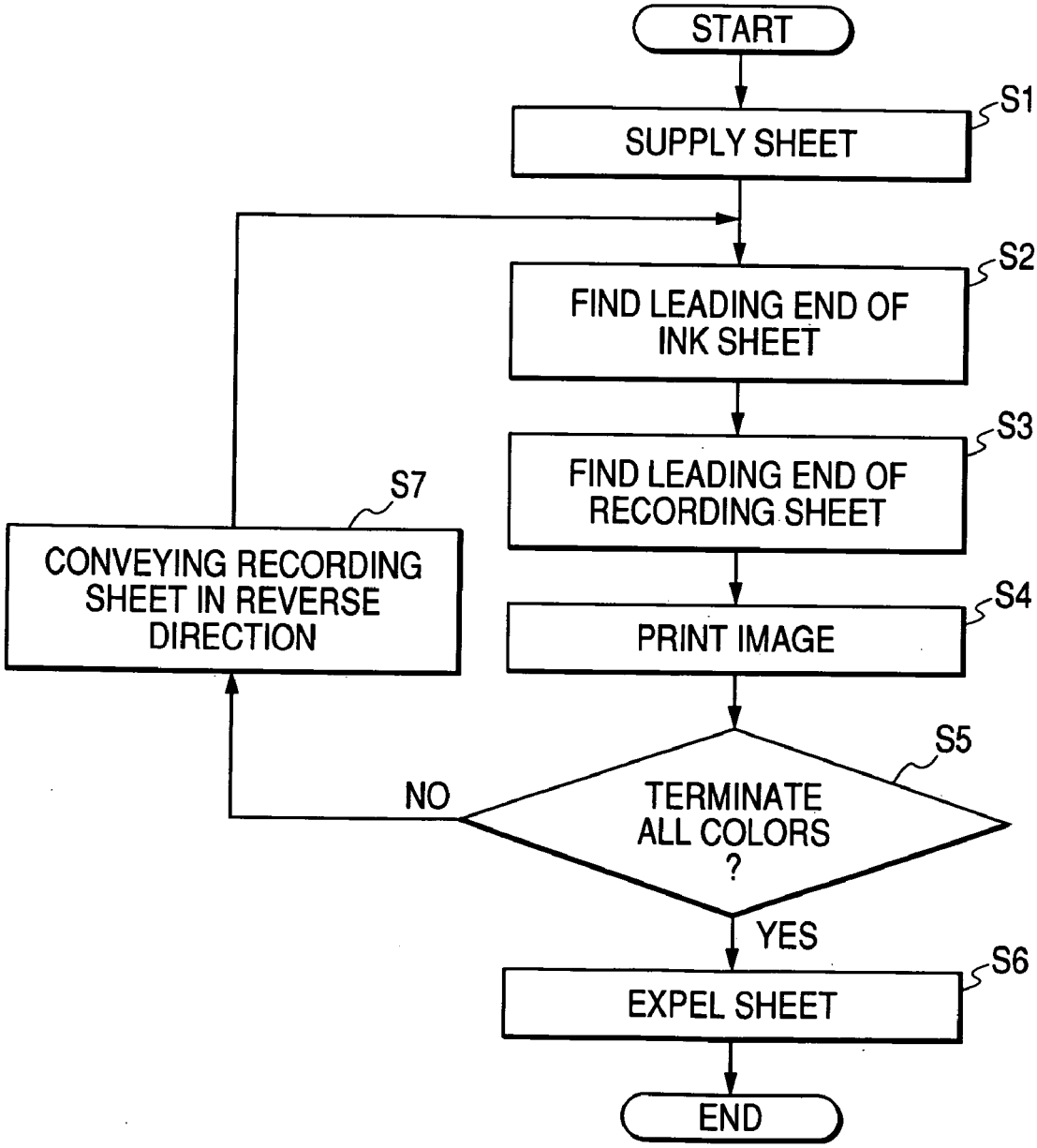
FIG. 3 is a flowchart of the first embodiment.

Then, the image printing action will be described referring to a flowchart shown in FIG. 3.

In Step S1, the sheet supply motor 216 is driven to feed the recording sheet stacked on storage portion 30 with a paper-feed roller 31.

In Step S2, an ink sheet pulley 2*a* is rotated by the ink sheet motor 215 so that a transfer start portion in the ink sheet 2 is located at the thermal head 1.

In Step S3, a feeding roller 8 is rotated by a feeding motor 217 so that the leading end of the recording sheet is located at the thermal head 1.

In Step S4, the recording is performed in the recording sheet. The leading end of the recording sheet P, which is found by the feeding roller 8 and a pinch roller 9, and the ink sheet 2 are pressed by the thermal head 1 and the platen roller 3. A solenoid 219 moves one of or both the thermal head 1 and the platen roller 3 to perform the press. Then, the conveying motor 6, the feeding motor 217, and the ink sheet motor 215 are driven to perform the conveyance of the recording sheet P by the feeding roller 8 and the endless belt 5 and movement of the ink sheet 2. During the conveyance, the ink on the ink sheet 2 is thermally transferred to the recording sheet P by the heat generation of the thermal head 1. The recording sheet P is conveyed with high accuracy by the frictional force between the surface of the endless belt 5 and the backside of the recording sheet P.

When the first color printing is ended, in Step S7, in order to perform the next color printing, the thermal head 1 is separated from the platen roller 3 to release the press of the thermal head 1, and a pair of a return roller 10 and the pinch roller 11 and the pair of the feeding roller 8 and the pinch roller 9 are rotated in the opposite direction to the printing direction to return the recording sheet P to the printing start position as shown in FIG. 1B. Then, the second color and subsequent other colors are printed by the same action as for the first color.

When the transfers for all the colors are ended, the flow goes to Step S6 to expel the recording sheet P, and the image formation is finished.

The difference between the first embodiment and the conventional examples and Japanese Patent No. 2531358 will be described below.

As shown in FIGS. 1A and 1B, in the platen roller of the first embodiment, although the endless belt exists between the recording sheet and the platen roller, the endless belt is a thin-film sheet having the thickness not more than 100 μm, so that the endless belt does not affect the pressures and the contact statuses between the printing surface of the recording sheet and the ink sheet and between the ink sheet and the thermal head, and the same printing conditions as for the conventional example can be obtained.

Further, because the conveyance of the recording sheet is determined by the friction between the backside of the recording sheet and the surface of the endless belt, the recording sheet is not affected by the hardness and the nip width of the platen roller, and the recording sheet is conveyed with high accuracy at the substantially same speed as the conveying speed of the endless belt.

As can be seen from FIGS. 1A and 1B, the endless belt 5 of the first embodiment is not driven by the platen roller while the belt is wound around the platen roller with the small winding angle like Japanese Patent No. 2531358, but the endless belt 5 is driven by the drive roller 4 while wound around the drive roller 4 with winding angle of the almost 180°. Thus, since the endless belt is wound around the drive roller 4, the endless belt 5 is conveyed with high accuracy without generating the slip between the drive roller 4 and the endless belt 5. When the drive roller 4 is the roller in which an elastic layer or ceramic particle coating layer, which has the thickness is not more than 1 mm, is formed around a metal shaft, the conveying accuracy is further improved.

Accordingly, in the configuration of the first embodiment of the invention, the endless belt 5 is driven by not the platen roller involved in the printing but the drive roller 4 in which the large winding angle is secured, so that the endless belt can be conveyed with high accuracy without generating the slip while the pressure and the contact status of the printing portion in the platen roller are kept at the same conditions as for the optimum conventional example. As a result, when the leading end of the recording sheet is inserted into the printing portion located between the thermal head 1 and the platen roller 3 by the feeding roller 8 and the pinch roller 9, since the recording sheet is conveyed by the endless belt 5, the printing can be performed to the whole range from the leading end to a rear end.

As described above, according to the first embodiment of the invention, in the thermal recording printer apparatus having the configuration in which the printing is performed with the small-diameter platen roller having the advantages for the miniaturization and the reduction in thickness of the apparatus, the endless belt can be conveyed with high accuracy to perform the printing to the whole surface of the recording sheet with no margin without impairing the print quality.

The thermal transfer type printer apparatus in which the ink in the ink sheet is heated to transfer the ink to the recording sheet is shown as an example in the first embodiment. However, the direct thermal type printer apparatus can be realized by the same configuration as for the thermal transfer type printer apparatus when the ink sheet is not used but the thermal recording paper having the heat-sensitive layer is used as the recording sheet. In the case of the color thermal recording paper, when a fixing device using a ultra-violet ray is required, the fixing device can be added as appropriate.

In order to further improve the endless-belt conveying accuracy, it is effective to increase the frictional coefficient by forming the thin layer made of elastic material around the drive roller 4. In this case, when the elastic layer is too thickened, since the deformation or the expansion by the tension affects the conveying accuracy, sometimes the conveying accuracy is decreased. Therefore, it is desirable that the elastic layer is set to the proper thickness.

In order to further improve the endless-belt conveying accuracy, it is effective to increase the frictional coefficient by forming the thin layer made of elastic material on the surface of the endless belt. In this case, when the elastic layer is too thickened, since the deformation or the expansion by the tension affects the conveying accuracy, sometimes the conveying accuracy is decreased. Therefore, it is desirable that the elastic layer is set to the proper thickness.

It is possible that the endless belt is one belt whose width is wider than a length in a longitudinal direction of the heat generating unit. In the case where the thickness of the endless belt is extremely thin and the printing is not affected even if the end portion of the endless belt exists in the printing range, it is possible that the endless belt is one belt whose width is narrower than the length in the longitudinal direction of the heat generating unit. For example, it is possible that the endless belt one belt whose width is narrower than a half of the length in the longitudinal direction of the heat generating unit. It is also possible that the endless belt is formed by the plural belts having widths which do not overlap each other.

Figure 4:
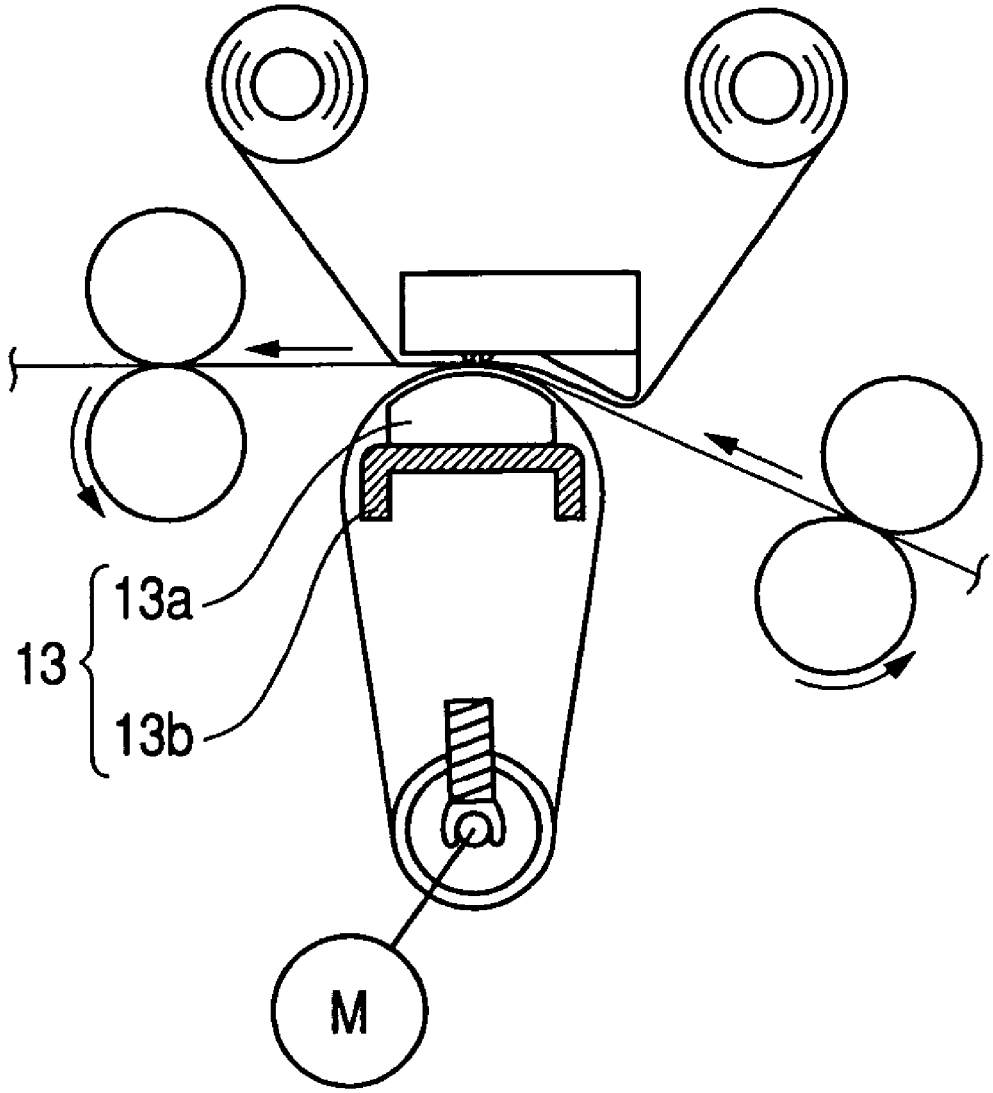
FIG. 4 shows another mode of pressing means of the invention.

It is possible that the platen roller which is of the pressing member is the rotatable roller as shown in FIGS. 1A and 1B. As shown in FIG. 4, it is possible that the pressing member is a fixed platen 13 in which a rigid support member 13*a* and an elastic body 13*b* constituting a part of a cylindrical surface are integrally fixed. In this case, when a rub surface between the elastic body 13*b* and the endless belt is coated with a surface layer whose frictional coefficient is lower than that of the elastic body, the friction force between the elastic body and the endless belt is decreased, which results in the merits that a drive torque is decreased and the conveying accuracy is improved.

As described above, in order to improve the conveying accuracy of the endless belt, the outer surface of the drive roller 4 is difficult to deform and the outer surface of the drive roller 4 is configured to increase the hardness. On the contrary, when compared with the drive roller 4, the platen roller is easy to deform and the platen roller is configured to decrease the hardness so that the contact statuses such as the pressure and the nip width between the thermal head and the ink sheet and between the ink sheet and the recording sheet are suitable to the thermal transfer.

Second Embodiment

Figure 5A:
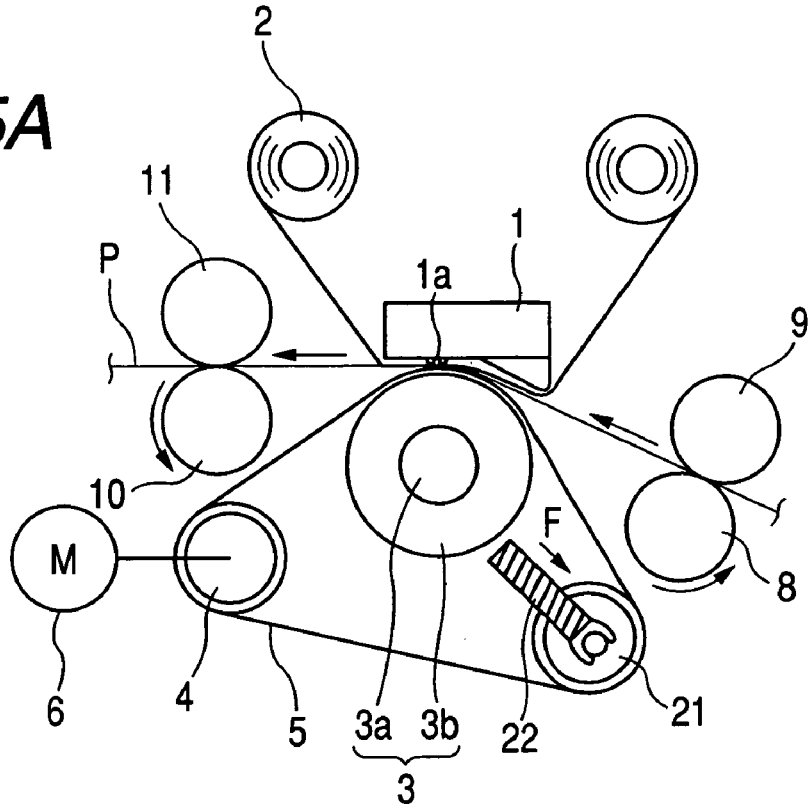
FIGS. 5A and 5B are explanatory views of a second embodiment of the invention.
Figure 5B:
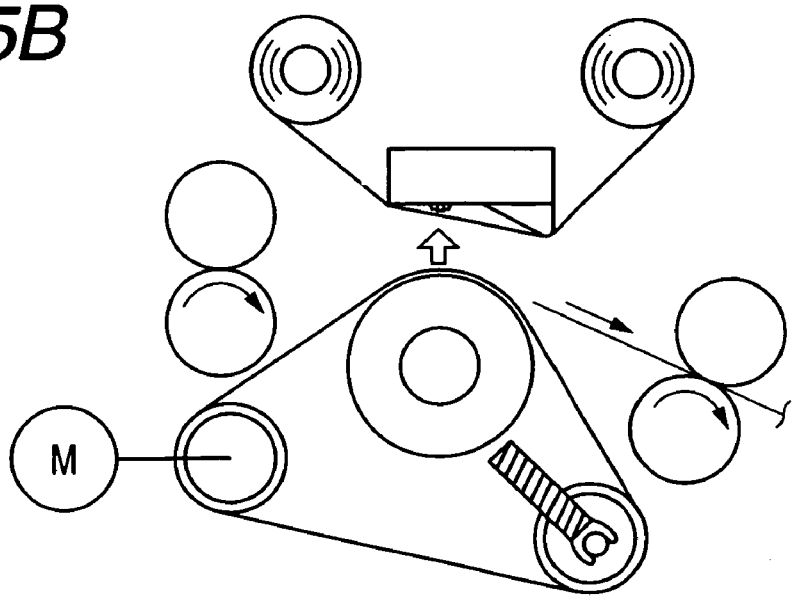

FIGS. 5A and 5B show thermal recording printer apparatus according to a second embodiment of the invention. In FIGS. 5A and 5B, the reference numeral 1 denotes the thermal head in which the heat generating unit 1*a* is formed. In the heat generating unit 1*a*, the plural heating resistors are linearly arranged. The reference numeral 2 denotes the ink sheet to which the ink is applied. The reference numeral 3 denotes the platen roller which is of the pressing member. The platen roller 3 is provided opposite to the heat generating unit of the thermal head 1 while being parallel to the heat generating unit. The platen roller 3 includes the central axis 3*a* and the elastic rubber roller 3*b*. The reference numeral 4 denotes the drive roller which is provided in parallel with the platen roller 3. The reference numeral 21 denotes an auxiliary roller which is of a second roller provided in parallel with the platen roller 3. The auxiliary roller 21 is rotatably supported. The reference numeral 5 denotes the endless belt which is extended with a tension so as to involve the platen roller 3, the drive roller 4, and the auxiliary roller 21. The reference numeral 6 denotes the drive means for rotating the drive roller 4.

As described above, since the endless belt hardly expands, when the rotating central shafts of the platen roller 3, the drive roller 4, and the auxiliary roller 21 are configured so as not to be adjusted, some times the tension is applied to the endless belt 5, or sometimes the tension is applied to the endless belt 5 too much. Accordingly, it is desirable that at least one of the positions of the platen roller 3, the drive roller 4, and the auxiliary roller 21 can be adjusted. Alternatively, it is desirable to provide a tension spring which is of bias means for biasing at least one of the platen roller 3, the drive roller 4, and the auxiliary roller 21 toward the direction in which the tension is applied to the endless belt.

Originally, from viewpoints of printing conditions, position accuracy between the platen roller 3 and the heat generating unit 1*a* of the thermal head 1 is important, and it is desirable that the platen roller 3 and the heat generating unit 1*a* are fixed with high accuracy. When a shift of a distance between centers of the drive means 6 and a gear in a drive transmission unit or an eccentric shift exists, since drive accuracy is adversely affected, it is desirable that the drive roller 4 is also fixed with high accuracy. In the first embodiment, the auxiliary roller 21 is provided, so that the platen roller 3 and the drive roller 4, for which the position accuracy is required, are fixed to the apparatus with high accuracy, and a tension spring 22 biases the auxiliary roller 21 to apply the tension to the endless belt 5.

The printing action will schematically be described below. As shown in FIG. 5A, for the printing, the ink sheet 2 and the recording sheet P conveyed by the feeding roller 8 and the pinch roller 9 are pressed by the thermal head 1 and the platen roller 3, and the recording sheet P is conveyed by friction feed between the surface of the endless belt 5 and the backside of the recording sheet P while the ink on the ink sheet 2 is transferred onto the recording sheet P by the heat generation of the thermal head 1. As shown in FIG. 5B, after the first color is ended, in order to perform the next color printing, the thermal head 1 is separated from the platen roller 3 to release the press of the thermal head 1, and the pair of the return roller 10 and the pinch roller 11 and the pair of the feeding roller 8 and the pinch roller 9 are rotated in the opposite direction to the printing direction to return the recording sheet P to the printing start position. Then, the second color and the subsequent colors are printed by the same action as for the first color.

As described above, according to the second embodiment of the invention, in the thermal recording printer apparatus having the configuration in which the printing is performed with the small-diameter platen roller having the advantages for the miniaturization and the reduction in thickness of the apparatus using the same principle as the first embodiment, the endless belt can be conveyed with high accuracy to perform the printing to the whole surface of the recording sheet with no margin without impairing the print quality.

According to the second embodiment, in addition to the same effect as the first embodiment, the auxiliary roller 21 is movably formed to apply the tension to the endless belt 5, while the platen roller 3 and the drive roller 4 for which the position accuracy is required are fixed. Therefore, higher-quality printer apparatus can be realized.

The materials and the structures of the endless belt, which are described in the first embodiment, can also be used in the second embodiment. As with the first embodiment, not only the thermal transfer type printer apparatus but the direct thermal type printer apparatus can obtain the same effect in the second embodiment. In the second embodiment, it is also possible that the thin layer made of the elastic material or the ceramic particle coating layer is formed around the drive roller. In the single-layer or multi-layer structure of the endless belt of the second embodiment, it is also necessary that the configuration is set as appropriate. In the endless belt of the second embodiment, there are several modes in the width and the number of endless belts. In the second embodiment, the platen roller which is of the pressing member can be realized by the fixed platen.

In order to improve the conveying accuracy of the endless belt, the outer surface of the drive roller 4 is difficult to deform and the outer surface of the drive roller 4 is configured to increase the hardness. On the contrary, when compared with the drive roller 4, the platen roller is easy to deform and the platen roller is configured to decrease the hardness so that the contact statuses such as the pressure and the nip width between the thermal head and the ink sheet and between the ink sheet and the recording sheet are suitable to the thermal transfer.

Third Embodiment

Figure 6A:
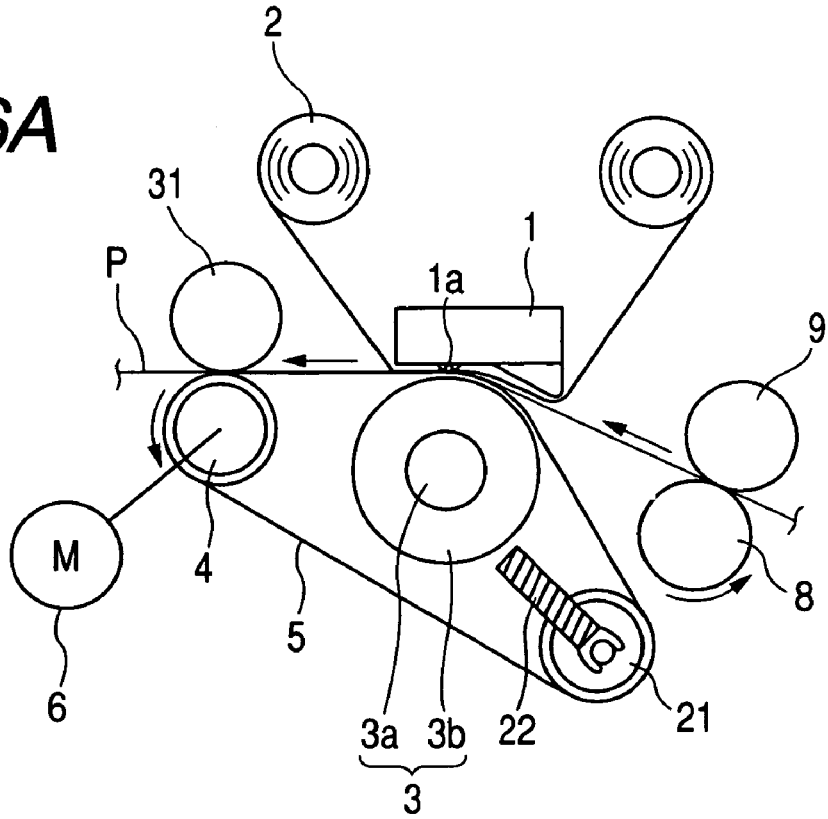
FIGS. 6A and 6B are explanatory views of a third embodiment of the invention.
Figure 6B:
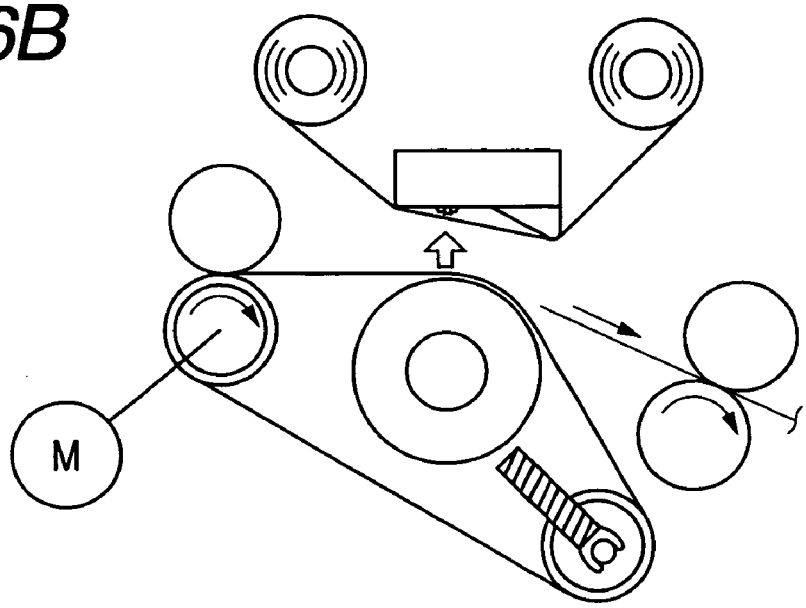

FIGS. 6A and 6B show a thermal transfer type printer apparatus according to a third embodiment of the invention. In FIGS. 6A and 6B, the reference numeral 1 denotes the thermal head in which the heat generating unit 1*a* is formed. In the heat generating unit 1*a*, the plural heating resistors are linearly arranged. The reference numeral 2 denotes the ink sheet to which the ink is applied. The reference numeral 3 denotes the platen roller which is of the pressing member. The platen roller 3 is provided opposite to the heat generating unit of the thermal head 1 while being parallel to the heat generating unit. The platen roller 3 includes the central axis 3*a* and the elastic rubber roller 3*b*. The reference numeral 4 denotes the drive roller which is provided in parallel with the platen roller 3. The reference numeral 21 denotes the auxiliary roller which is provided in parallel with the platen roller 3. The reference numeral 5 denotes the endless belt which is extended with a tension so as to involve the platen roller 3, the drive roller 4, and the auxiliary roller 21. The reference numeral 6 denotes the drive means for rotating the drive roller 4. The reference numeral 22 is the tension spring which biases the auxiliary roller 21 to apply the tension to the endless belt 5. The reference numeral 31 is a pinch roller which is provided opposite the drive roller 4 while rotatably driven by the endless belt 5.

The printing action will schematically be described below. As shown in FIG. 6A, for the printing, the ink sheet 2 and the recording sheet P conveyed by the feeding roller 8 and the pinch roller 9 are pressed by the thermal head 1 and the platen roller 3. The recording sheet P is conveyed by the endless belt 5 while the ink on the ink sheet 2 is transferred onto the recording sheet P by the heat generation of the thermal head 1.

As shown in FIG. 6B, after the first color is ended, in order to perform the next color printing, the thermal head 1 is separated from the platen roller 3 to release the press of the thermal head 1, and the pair of the drive roller 4 and the pinch roller 31 and the pair of the feeding roller 8 and the pinch roller 9 are rotated in the opposite direction to the printing direction to return the recording sheet P to the printing start position. Then, the second color and the subsequent colors are printed by the same action as for the first color.

As described above, according to the third embodiment of the invention, in the thermal recording printer apparatus having the configuration in which the printing is performed with the small-diameter platen roller having the advantages for the miniaturization and the reduction in thickness of the apparatus using the same principle as the first and second embodiments, the endless belt can be conveyed with high accuracy to perform the printing to the whole surface of the recording sheet with no margin without impairing the print quality.

According to the second embodiment, in addition to the same effect as the first and second embodiments, the recording sheet P on the endless belt 5 is conveyed by the friction feed at two points, i.e. the portion where the recording sheet P and the endless belt 5 are nipped between the thermal head 1 and the platen roller 3 and the portion where the recording sheet P and the endless belt 5 are nipped between the drive roller 4 and the pinch roller 31. Therefore, higher-quality printer apparatus can be realized.

The materials and the structures of the endless belt, which are described in the first embodiment, can also be used in the third embodiment. As with the first embodiment, applying the tension to the endless belt not using the platen roller and the drive roller but using the auxiliary roller, and using not only the thermal transfer type printer apparatus but the direct thermal type printer apparatus can obtain the same effect in the third embodiment. In the third embodiment, it is also possible that the thin layer made of the elastic material or the ceramic particle coating layer is formed around the drive roller. In the single-layer or multi-layer structure of the endless belt of the third embodiment, it is also necessary that the configuration is set as appropriate. In the endless belt of the third embodiment, there are several modes in the width and the number of endless belts. In the third embodiment, the platen roller which is of the pressing member can be realized by the fixed platen.

In order to improve the conveying accuracy of the endless belt, the outer surface of the drive roller 4 is difficult to deform and the outer surface of the drive roller 4 is configured to increase the hardness. On the contrary, when compared with the drive roller 4, the platen roller is easy to deform and the platen roller is configured to decrease the hardness so that the contact statuses such as the pressure and the nip width between the thermal head and the ink sheet and between the ink sheet and the recording sheet are suitable to the thermal transfer.

Fourth Embodiment

Figure 7A:
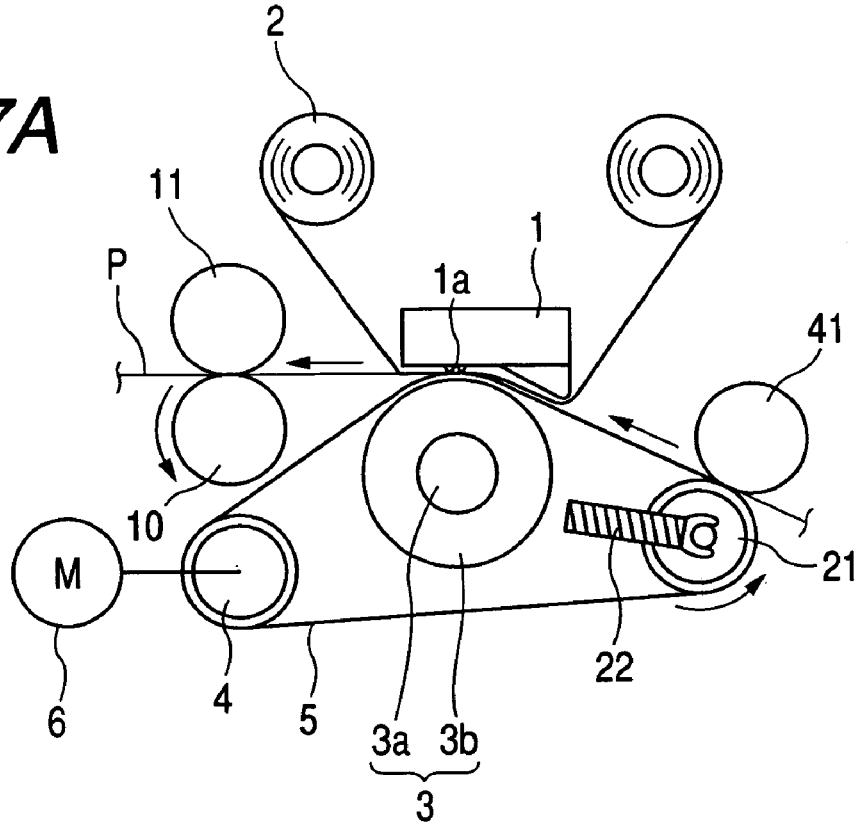
FIGS. 7A and 7B are explanatory views of a fourth embodiment of the invention.
Figure 7B:
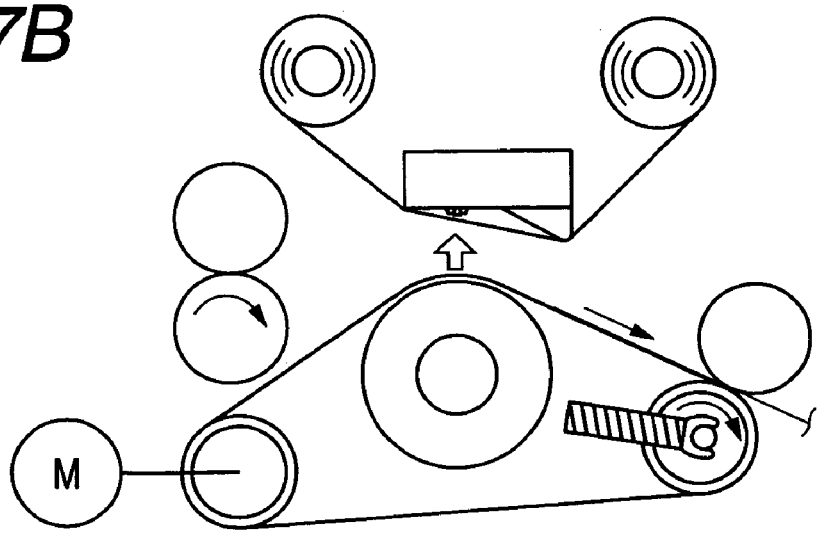

FIGS. 7A and 7B show a thermal recording printer apparatus according to a fourth embodiment of the invention.

In FIGS. 7A and 7B, the reference numeral 1 denotes the thermal head in which the heat generating unit 1*a* is formed. In the heat generating unit 1*a*, the plural heating resistors are linearly arranged. The reference numeral 2 denotes the ink sheet to which the ink is applied. The reference numeral 3 denotes the platen roller which is of the pressing member. The platen roller 3 is provided opposite to the heat generating unit of the thermal head 1 while being parallel to the heat generating unit. The platen roller 3 includes the central axis 3*a* and the elastic rubber roller 3*b*. The reference numeral 4 denotes the drive roller which is provided in parallel with the platen roller 3. The reference numeral 21 denotes the auxiliary roller which is provided in parallel with the platen roller 3. The reference numeral 5 denotes the endless belt which is extended with a tension so as to involve the platen roller 3, the drive roller 4, and the auxiliary roller 21. The reference numeral 6 denotes the drive means for rotating the drive roller 4. The reference numeral 22 is the tension spring which biases the auxiliary roller 21 to apply the tension to the endless belt 5. The reference numeral 41 is a pinch roller which is provided opposite the auxiliary roller 21 while rotatably driven by the endless belt 5.

The printing action will schematically be described below. As shown in FIG. 7A, for the printing, the ink sheet 2 and the recording sheet P conveyed by the auxiliary roller 21 and the pinch roller 41 are pressed by the thermal head 1 and the platen roller 3, and the recording sheet P is conveyed by the endless belt 5 while the ink on the ink sheet 2 is transferred onto the recording sheet P by the heat generation of the thermal head 1. As shown in FIG. 7B, after the first color is ended, in order to perform the next color printing, the press of the thermal head 1 is released, and the pair of the return roller 10 and the pinch roller 11 and the pair the auxiliary roller 21 and the pinch roller 41 are rotated in the opposite direction to the printing direction to return the recording sheet P to the printing start position. Then, the second color and the subsequent colors are printed by the same action as for the first color.

As described above, according to the fourth embodiment of the invention, in the thermal recording printer apparatus having the configuration in which the printing is performed with the small-diameter platen roller having the advantages for the miniaturization and the reduction in thickness of the apparatus using the same principle as the first second embodiments, the endless belt can be conveyed with high accuracy to perform the printing to the whole surface of the recording sheet with no margin without impairing the print quality.

According to the fourth embodiment, in addition to the same effect as the first and second embodiments, the recording sheet P on the endless belt 5 is conveyed by the friction feed at two points, i.e. the portion where the recording sheet P and the endless belt 5 are nipped between the thermal head 1 and the platen roller 3 and the portion where the recording sheet P and the endless belt 5 are nipped between the auxiliary roller 21 and the pinch roller 41. Therefore, higher-quality printer apparatus can be realized.

The materials and the structures of the endless belt, which are described in the first embodiment, can also be used in the fourth embodiment. As with the first embodiment, applying the tension to the endless belt not using the platen roller and the drive roller but using the auxiliary roller, using not only the thermal transfer type printer apparatus but the direct thermal type printer apparatus can obtain the same effect on the fourth embodiment. In the fourth embodiment, it is also possible that the thin layer made of the elastic material or the ceramic particle coating layer is formed around the drive roller. In the single-layer or multi-layer structure of the endless belt of the fourth embodiment, it is also necessary that the configuration is set as appropriate. In the endless belt of the fourth embodiment, there are several modes in the width and the number of endless belts. In the fourth embodiment, the platen roller which is of the pressing member can be realized by the fixed platen.

In order to improve the conveying accuracy of the endless belt, the outer surface of the drive roller 4 is difficult to deform and the outer surface of the drive roller 4 is configured to increase the hardness. On the contrary, when compared with the drive roller 4, the platen roller is easy to deform and the platen roller is configured to decrease the hardness so that the contact statuses such as the pressure and the nip width between the thermal head and the ink sheet and between the ink sheet and the recording sheet are suitable to the thermal transfer.

Fifth Embodiment

Figure 8A:
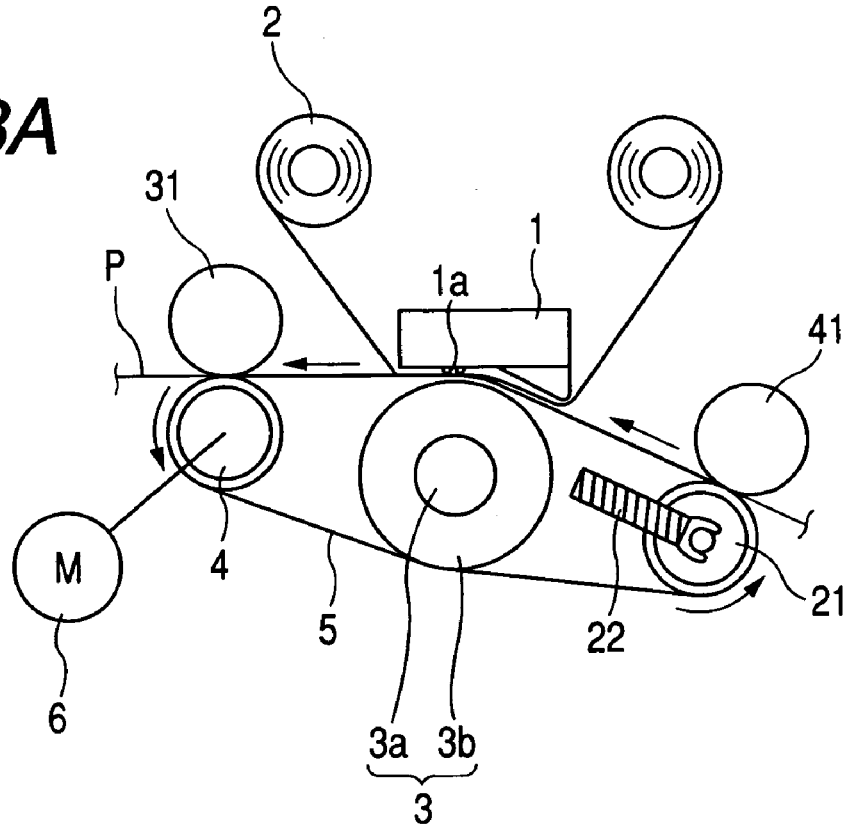
FIGS. 8A and 8B are explanatory views of a fifth embodiment of the invention.
Figure 8B:
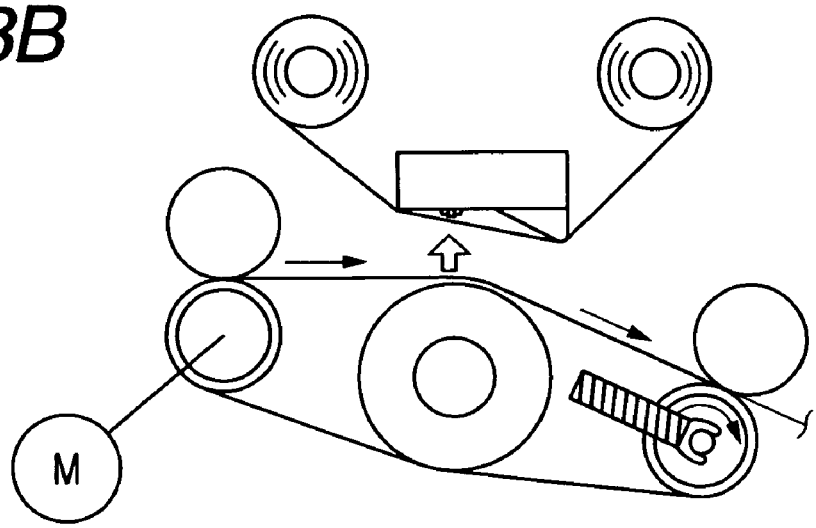
Figure 9A:
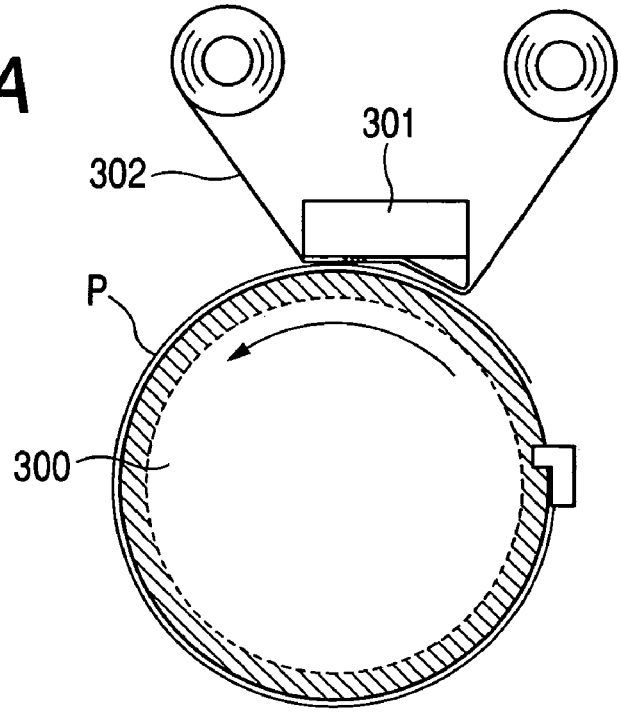
FIGS. 9A and 9B are explanatory views showing a first example of the conventional printer apparatus.
Figure 9B:
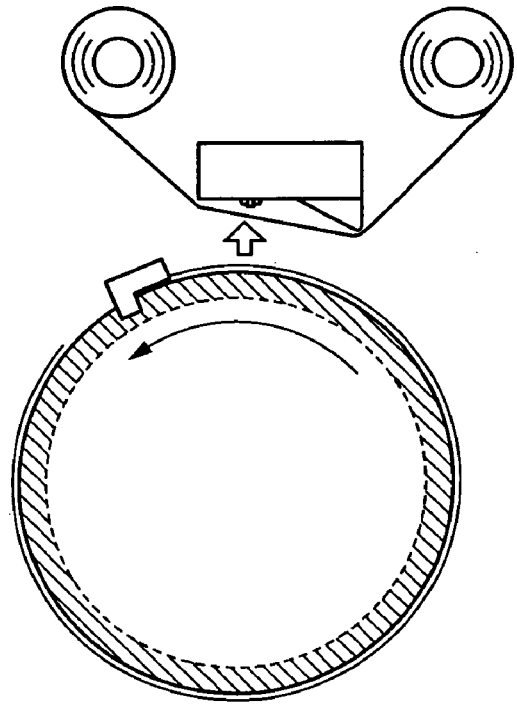
Figure 10A:
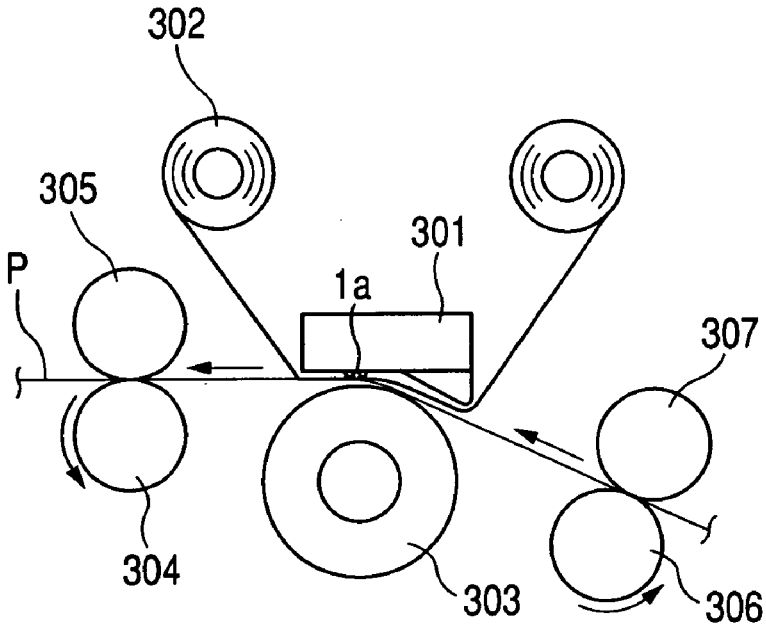
FIGS. 10A and 10B are explanatory views showing a second example of the conventional printer apparatus.
Figure 10B:
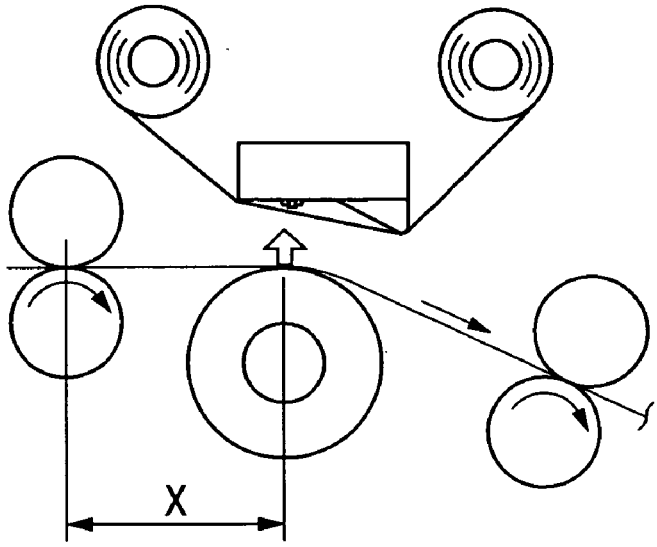

FIGS. 8A and 8B show a thermal recording printer apparatus according to a fifth embodiment of the invention. In FIGS. 8A and 8B, the reference numeral 1 denotes the thermal head in which the heat generating unit 1*a* is formed. In the heat generating unit 1*a*, the plural heating resistors are linearly arranged. The reference numeral 2 denotes the ink sheet to which the ink is applied. The reference numeral 3 denotes the platen roller which is of the pressing member. The platen roller 3 is provided opposite to the heat generating unit of the thermal head 1 while being parallel to the heat generating unit. The platen roller 3 includes the central axis 3*a* and the elastic rubber roller 3*b*. The reference numeral 4 denotes the drive roller which provided in parallel with the platen roller 3. The reference numeral 21 denotes the auxiliary roller which is provided in parallel with the platen roller 3. The reference numeral 5 denotes the endless belt which is extended with a tension so as to involve the platen roller 3, the drive roller 4, and the auxiliary roller 21. The reference numeral 6 denotes the drive means for rotating the drive roller 4. The reference numeral 22 is the tension spring which biases the auxiliary roller 21 to apply the tension to the endless belt 5. The reference numeral 31 is the pinch roller which is provided opposite the drive roller 4. The reference numeral 41 is the pinch roller which is provided opposite the auxiliary roller 21.

The printing action will schematically be described below. As shown in FIG. 8A, for the printing, the ink sheet 2 and the recording sheet P conveyed by the auxiliary roller 21 and the pinch roller 41 are pressed by the thermal head 1 and the platen roller 3, and the recording sheet P is conveyed by the endless belt 5 while the ink on the ink sheet 2 is transferred onto the recording sheet P by the heat generation of the thermal head 1.

As shown in FIG. 8B, after the first color is ended, in order to perform the next color printing, the press of the thermal head 1 is released, and the pair of the drive roller 4 and the pinch roller 31 and the pair of the auxiliary roller 21 and the pinch roller 41 are rotated in the opposite direction to the printing direction to return the recording sheet P to the printing start position. Then, the second color and the subsequent colors are printed by the same action as for the first color.

As described above, according to the fifth embodiment of the invention, in the thermal recording printer apparatus having the configuration in which the printing is performed with the small-diameter platen roller having the advantages for the miniaturization and the reduction in thickness of the apparatus using the same principle as the first to fourth embodiments, the endless belt can be conveyed with high accuracy to perform the printing to the whole surface of the recording sheet with no margin without impairing the print quality.

According to the fourth embodiment, in addition to the same effects as the first to fourth embodiments, the recording sheet P on the endless belt 5 is conveyed by the friction feed at three points, i.e. the portion where the recording sheet P and the endless belt 5 are nipped between the thermal head 1 and the platen roller 3, the portion where the recording sheet P and the endless belt 5 are nipped between the drive roller 4 and the pinch roller 31, and the portion where the recording sheet P and the endless belt 5 are nipped between the auxiliary roller 21 and the pinch roller 41. Therefore, higher-quality printer apparatus can be realized.

The materials and the structures of the endless belt, which are described in the first embodiment, can also be used in the fifth embodiment. As with the first embodiment, applying the tension to the endless belt not using the platen roller and the drive roller but using the auxiliary roller, and using not only the thermal transfer type printer apparatus but the direct thermal type printer apparatus can obtain the same effect on the fifth embodiment. In the fifth embodiment, it is also possible that the thin layer made of the elastic material or the ceramic particle coating layer is formed around the drive roller. In the single-layer or multi-layer structure of the endless belt of the fifth embodiment, it is also necessary that the configuration is set as appropriate. In the endless belt of the fifth embodiment, there are several modes in the width and the number of endless belts. In the fifth embodiment, the platen roller which is of the pressing member can be realized by the fixed platen.

In order to improve the conveying accuracy of the endless belt, the outer surface of the drive roller 4 is difficult to deform and the outer surface of the drive roller 4 is configured to increase the hardness. On the contrary, when compared with the drive roller 4, the platen roller is easy to deform and the platen roller is configured to decrease the hardness so that the contact statuses such as the pressure and the nip width between the thermal head and the ink sheet and between the ink sheet and the recording sheet are suitable to the thermal transfer.

This application claims priority from Japanese Patent Application No. 2004-085010 filed Mar. 23, 2004, which is hereby incorporated by reference herein.

What is claimed is:

1. A printer apparatus comprising:

a thermal head which has a plurality of heat generating elements;

an ink sheet to which ink is applied;

a platen roller which is rotatably supported and provided opposite the heat generating elements of the thermal head;

a first roller which is provided in parallel with the platen roller; and an endless belt which conveys a recording sheet, the endless belt being extended with a tension so as to involve the platen roller and the first roller, wherein a first surface of the recording sheet contacts a surface of the endless belt and a second surface of the recording sheet opposite to the first surface contacts the ink sheet, and the ink sheet, the endless belt, and the recording sheet are sandwiched by the thermal head and the platen roller, printing is performed by heating the ink in the ink sheet with the heat generating elements of the thermal head to transfer the ink to the recording sheet, the endless belt is driven by the first roller driven by driving means to convey the recording sheet, and the recording sheet is conveyed by a friction force between the first surface of the recording sheet and the surface of the endless belt.

2. A printer apparatus according to claim 1, further comprising bias means for biasing the platen roller in a direction away from the first roller.

3. A printer apparatus according to claim 1, wherein the first roller is formed by a metal shaft.

4. A printer apparatus according to claim 3, wherein the first roller has an elastic layer having thicknesses not more than 1 mm formed around the metal shaft.

5. A printer apparatus according to claim 3, wherein the first roller has a ceramic particle coating layer formed around the metal shaft.

6. A printer apparatus according to claim 1, wherein the endless belt has a single-layer structure of a heat-resisting resin layer.

7. A printer apparatus according to claim 1, wherein the endless belt has a multi-layer structure in which a heat-resisting resin layer is formed inside the endless belt and an elastic rubber layer is formed outside the endless belt.

8. A printer apparatus according to claim 1, wherein the endless belt has a multi-layer structure in which a heat-resisting resin layer is formed inside the endless belt and a ceramic particle coating layer is formed outside the endless belt.

9. A printer apparatus according to claim 1, wherein the endless belt is a single belt having a width wider than a length of the heat generating elements in a longitudinal direction.

10. A printer apparatus according to claim 1, wherein the endless belt is a single belt having a width narrower than a half of the length of the heat generating elements in a longitudinal direction.

11. A printer apparatus according to claim 1, wherein the endless belt is formed by a plurality of belts having widths which do not overlap each other.

12. A printer apparatus according to claim 1, wherein the platen roller has a cylindrical elastic body formed around a rigid shaft.

13. A printer apparatus according to claim 1, further comprising a second roller about which the endless belt is involved, the second roller being provided in parallel with the first roller.

14. A printer apparatus according to claim 13, further comprising bias means for biasing the second roller in a direction away from the platen roller.

15. A printer apparatus according to claim 1, further comprising a roller which is provided outside the endless belt while being provided opposite the first roller, the roller being able to be rotatably driven by the recording sheet conveyed by the endless belt.

16. A printer apparatus according to claim 1, further comprising a roller which is provided outside the endless belt while being provided opposite the second roller, the roller being able to be rotatably driven by the recording sheet conveyed by the endless belt.

17. A printer apparatus which has a printing unit, comprising:

a thermal head which has a plurality of heat generating elements;

a platen roller which is rotatably supported and provided in parallel with the heat generating elements of the thermal head while being provided opposite the heat generating elements of the thermal head;

a first roller which is provided in parallel with the platen roller; and an endless belt which is extended with a tension so as to involve the platen roller and the first roller, wherein the thermal head is pressed against the platen roller through the endless belt, printing is performed by heating the recording sheet with the heat generating elements of the thermal head to perform color development of a heat-sensitive layer in the recording sheet, the endless belt is driven by the first roller driven by driving means to convey the recording sheet, a surface of the recording sheet contacts a surface of the endless belt, the recording sheet being conveyed by a friction force between the surface of the recording sheet and the surface of the endless belt, and the endless belt and the recording sheet are sandwiched between the thermal head and the platen roller.

18. A printer apparatus according to claim 1 or 17, further comprising bias means for biasing the first roller in a direction away from the platen roller.

19. An image forming apparatus comprising:

an endless belt which conveys a recording sheet;

a platen roller that is rotatably supported;

a drive roller which supports the endless belt in conjunction with the platen roller, the drive roller moving the endless belt by a driving force from a drive source; and a thermal head for transferring ink in the ink sheet to the recording sheet, wherein a first surface of the recording sheet contacts a surface of the endless belt and a second surface of the recording sheet opposite to the first surface contacts the ink sheet, and the ink sheet, the endless belt, and the recording sheet are sandwiched between the thermal head and the platen roller, and the recording sheet is conveyed by a friction force between the first surface of the recording sheet and the surface of the endless belt.

20. An image forming apparatus according to claim 19, further comprising bias means for biasing the drive roller toward a direction in which tension is imparted to the endless belt.

21. An image forming apparatus according to claim 19, wherein the drive roller is formed by a metal shaft.

22. An image forming apparatus according to claim 21, wherein the drive roller has an elastic layer having thicknesses not more than 1 mm formed around the metal shaft.

23. An image forming apparatus according to claim 21, wherein the drive roller has a ceramic particle coating layer formed around the metal shaft.

24. An image forming apparatus according to claim 19, wherein the endless belt has a heat-resisting resin layer.

25. An image forming apparatus according to claim 19, further comprising a rotatable second roller which supports the endless belt in conjunction with the drive roller.

26. An image forming apparatus according to claim 25, further comprising bias means for biasing the second roller toward a direction in which tension is imparted to the endless belt.

27. An image forming apparatus according to claim 25, further comprising a roller which is provided opposite the second roller, the roller being able to be rotatably driven by the recording sheet conveyed by the endless belt.

28. An image forming apparatus according to claim 19, further comprising a roller which is provided opposite the drive roller, the roller being able to be rotatably driven by the recording sheet conveyed by the endless belt.

* * * * *

UNITED STATES PATENT AND TRADEMARK OFFICE

CERTIFICATE OF CORRECTION

PATENT NO. : 7,423,663 B2
APPLICATION NO. : 11/080413
DATED : September 9, 2008
INVENTOR(S) : Nishitani It is certified that error appears in the above-identified patent and that said Letters Patent is hereby corrected as shown below:

COLUMN 1
Line 45, “image print” should read --image is printed--.

COLUMN 3
Line 22, “with a tension” (second occurrence) should be deleted.
Line 25, “with a tension” (second occurrence) should be deleted.
Line 42, “adopted” should read --adapted--.
Line 47, “fore going,” should read --foregoing,--.
Line 62, “with a tension” should be deleted.
Line 66, “conditions” should read --condition--.

COLUMN 5
Line 10, “is required” should read --as required--.
Line 14, “contract,” should read --contracts,--.

COLUMN 6
Line 34, “winding” should read --a winding--; and “the almost” should read --almost--.
Line 40, “is not” should read --of not--.
Line 43, “by not” should read --not by--.

COLUMN 7
Line 5, “a ultra-violet” should read --an ultra-violet--.
Line 31, “one belt” should read --is one belt--.

COLUMN 8
Line 7, “is of a” should read --is a--.
Line 16, “some times” should read --sometimes--.

UNITED STATES PATENT AND TRADEMARK OFFICE

CERTIFICATE OF CORRECTION

PATENT NO. : 7,423,663 B2
APPLICATION NO. : 11/080413
DATED : September 9, 2008
INVENTOR(S) : Nishitani It is certified that error appears in the above-identified patent and that said Letters Patent is hereby corrected as shown below:

COLUMN 11
Line 32, "first second" should read --first and second--.

COLUMN 12
Line 20, "provided" should read --is provided--.

Signed and Sealed this

Seventeenth Day of March, 2009

JOHN DOLL
*Acting Director of the United States Patent and Trademark Office*